US010064486B1

(12) United States Patent
Sun

(10) Patent No.: US 10,064,486 B1
(45) Date of Patent: Sep. 4, 2018

(54) PULL-OUT BASKET FOR KITCHEN CUPBOARD

(71) Applicant: Yanfeng Sun, Hunan (CN)

(72) Inventor: Yanfeng Sun, Hunan (CN)

( * ) Notice: Subject to any disclaimer, the term of this patent is extended or adjusted under 35 U.S.C. 154(b) by 0 days.

(21) Appl. No.: 15/867,746

(22) Filed: Jan. 11, 2018

(30) Foreign Application Priority Data

Nov. 17, 2017 (CN) ..... 2017 2 1537484 U

(51) Int. Cl.

| | |
|---|---|
| ***A47B 88/40*** | (2017.01) |
| ***A47B 88/477*** | (2017.01) |
| ***A47B 77/02*** | (2006.01) |
| ***A47B 88/46*** | (2017.01) |
| ***A47B 88/497*** | (2017.01) |

(52) U.S. Cl.
CPC ..... *A47B 88/477* (2017.01); *A47B 77/02* (2013.01); *A47B 88/46* (2017.01); *A47B 88/497* (2017.01); *A47B 2088/401* (2017.01)

(58) Field of Classification Search
CPC ..... A47B 77/02; A47B 88/40; A47B 88/46; A47B 88/497; A47B 88/477
USPC ..... 312/330.1, 334.1, 334.6, 334.27, 334.31, 312/333, 319.1, 319.8; 211/126.15
See application file for complete search history.

(56) References Cited

U.S. PATENT DOCUMENTS

2008/0231155 A1* 9/2008 Shen ..... A47B 88/40 312/334.8
2009/0273263 A1* 11/2009 Berger ..... A47B 88/467 312/334.1
2013/0002115 A1* 1/2013 Friesenecker ..... A47B 88/493 312/334.8
2014/0319986 A1* 10/2014 Brunnmayr ..... A47B 88/0481 312/319.1
2017/0172301 A1* 6/2017 Janzen ..... E05F 5/02

* cited by examiner

*Primary Examiner* — James O Hansen

(57) ABSTRACT

A pull-out basket for kitchen cupboard, having a basket and two sliding rail structures on which the two sliding rail structures are mounted; each of the sliding rail structures contains a fixed slot; a middle section of the fixed slot is mounted with a hydraulic damper; an outer side of the second sliding gear rack is provided with a position limiting guiding slot; the position limiting guiding slot is connected with a first sliding gear rack through a gear; the first sliding gear rack is mounted with a sliding slot; the hydraulic damper has a cylinder; an end of the cylinder is connected with a piston rod; the piston rod and a tensile resilient member is connected with a connection block; the connection block is connected with a locking block; a hanging hook is connected onto the sliding slot.

7 Claims, 3 Drawing Sheets

PULL-OUT BASKET FOR KITCHEN CUPBOARD

BACKGROUND OF THE INVENTION

The present invention relates to the field of home furniture, and more specifically relates to a pull-out basket for kitchen cupboard.

Currently, kitchen cupboard for household use is still one of the hot products in the market. User's experience becomes an important users' concern as the general living standard increases. Kitchen cupboards having unfriendly designs, producing loud noises, and bringing inconvenience to the users will not succeed in the market. Users planning to purchase have high regard on whether the kitchen cupboards or the like can enhance their comfort of living. A kind of kitchen cupboard having a fashionable appearance while producing less pulling noise is still lacking in the market.

BRIEF SUMMARY OF THE INVENTION

In view of the aforesaid disadvantages, the present invention provides a pull-out basket of kitchen cupboard, which can eliminate noises caused by pulling and therefore increase the comfort of living.

A pull-out basket for kitchen cupboard, comprising a basket and two sliding rail structures; the pull-out basket is mounted above the two sliding rail structures; each of the sliding rail structures comprises a fixed slot; the fixed slot is embodied as a linear tube; one end of the fixed slot is removably provided with a fixed sleeve; a middle section of the fixed slot is mounted with a hydraulic damper; another end of the fixed slot is provided with a fixed seat and a second sliding gear rack; through holes are respectively provided on the fixed seat and the fixed sleeve; an outer side of the second sliding gear rack is provided with a position limiting guiding slot; the position limiting guiding slot is connected with a first sliding gear rack through a gear; the first sliding gear rack is mounted with a sliding slot; the hydraulic damper comprises a cylinder; an end of the cylinder is connected with a piston rod; a tensile resilient member is mounted below the cylinder; the piston rod and the tensile resilient member is connected with a connection block; the connection block is connected with a locking block; a hanging hook is connected onto the sliding slot; intermediate blocks are provided at a bottom side of the basket; each of the intermediate blocks is connected with the sliding slot via a bolt or a screw.

Preferably, the tensile resilient member is a tensile spring.

Preferably, the hydraulic damper achieves silencing and buffering effects when the sliding rail structures extend and retract.

Preferably, the hanging hook pulls the locking block, which is turned to be fixed in position and locked after arriving an end point.

Preferably, the tensile spring provides a reverse pulling force to the hanging hook.

Preferably, the connection block and the locking block are slidable inside the position limiting guiding slot.

Preferably, the fixed sleeve is made of plastics.

The present invention has the following beneficial effects: The present invention eliminates noises conventionally produced when the basket is pulled out from the kitchen cupboard by using the hydraulic damper which provides better users' experience. Besides, the hydraulic damper eliminates noises when the basket is pulled out, thereby enhancing the comfort of living.

REFERENCE SIGNS IN THE DRAWINGS

100—sliding rail structures; 200—basket; 110—hydraulic damper; 120—fixed sleeve; 130—fixed slot; 131—fixed seat; 140—second sliding gear rack; 150—position limiting guiding slot; 160—gear; 170—sliding slot; 180—first sliding gear rack; 111—tensile resilient member; 112—connection block; 113—cylinder; 114—piston rod; 115—locking block; 116—hanging hook; 210—intermediate blocks

DETAILED DESCRIPTION OF THE INVENTION

In order to further comprehend the features, solutions, objects and purposes of the present invention, the present invention will be described further in detail below with reference to an embodiment and the drawings.

The present invention is explained in detail below with reference to the embodiment and the drawings so that the objects, technical solutions and advantages of the present invention will become more apparent. It should be understood that the embodiment described herein is intended only to explain the present invention and should not be considered limiting the present invention.

Figure 1:
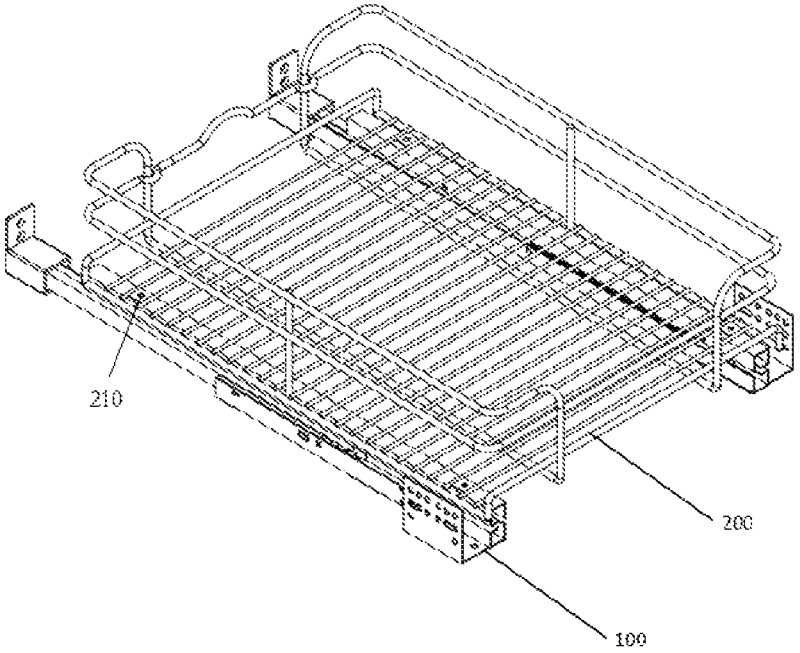
FIG. 1 is a structural view of a pull-out basket for a kitchen cupboard according to the present invention.
Figure 2:
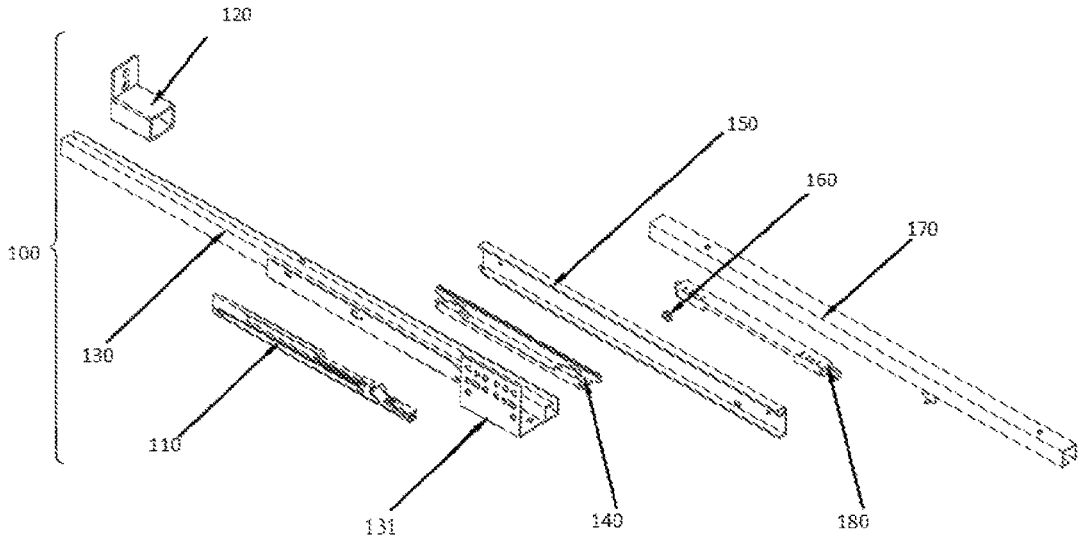
FIG. 2 is a structural view showing a sliding rail of the pull-out basket for the kitchen cupboard according to the present invention.
Figure 3:
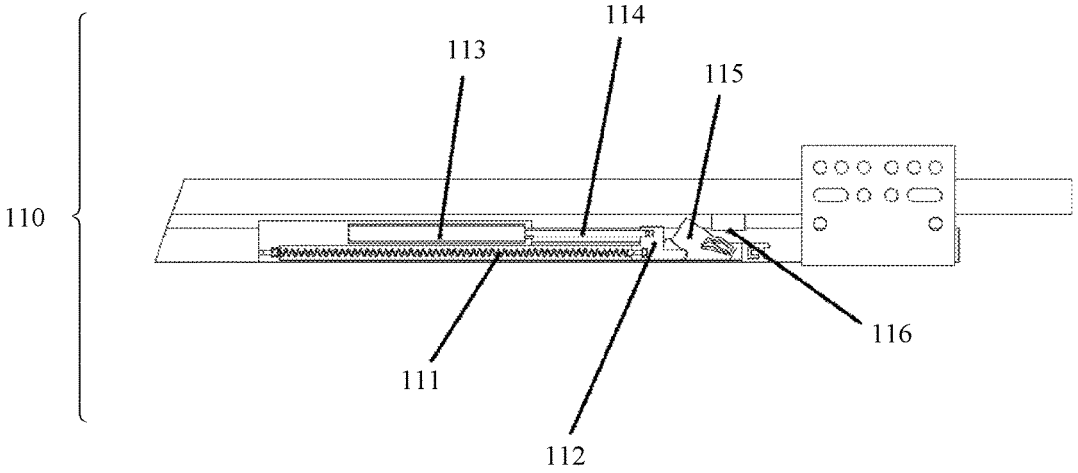
FIG. 3 is a structural view showing a hydraulic damper of the pull-out basket for the kitchen cupboard according to the present invention.

As shown in FIGS. 1-3, a pull-out basket for kitchen cupboard comprises a basket 200 and two sliding rail structures 100; each of the sliding rail structures 100 comprises a fixed slot 130; the fixed slot 130 is embodied as a linear tube; one end of the fixed slot 130 is removably provided with a fixed sleeve 120; a middle section of the fixed slot 130 is mounted with a hydraulic damper 110; another end of the fixed slot 130 is provided with a fixed seat 131 and a second sliding gear rack 140; an outer side of the second sliding gear rack 140 is provided with a position limiting guiding slot 150; the position limiting guiding slot 150 is connected with a first sliding gear rack 180 through a gear 160; the first sliding gear rack 180 is mounted with a sliding slot 170; the hydraulic damper 110 comprises a cylinder 113; an end of the cylinder 113 is connected with a piston rod 114; a tensile resilient member 111 is mounted below the cylinder 113; the piston rod 114 and the tensile resilient member 111 is connected with a connection block 112; the connection block 112 is connected with a locking block 115; a hanging hook 116 is connected onto the sliding slot 170; intermediate blocks 210 are provided at a bottom side of the basket 200; each of the intermediate blocks 210 is connected with the sliding slot 170 via a bolt or a screw, and is connected to a top side of the sliding slot 170.

The fixed sleeve 120 is removably connected with the fixed slot 130 to facilitate removal or position adjustment of the fixed sleeve 120.

Through holes are respectively provided on the fixed seat 131 and the fixed sleeve 120 for screws to pass through so that the fixed seat 131 and the fixed sleeve 120 can be connected to other components.

The fixed sleeve 120 is a non-metal plastic component so that it can be more stably and conveniently connected with the fixed slot 130 and can achieve better fixing effect by using screws.

As shown in FIGS. 1-3, the tensile resilient member 111 is a tensile spring; the hydraulic damper 110 achieves silencing and buffering effects when the sliding rail structures 100 extend and retract; the hanging hook 116 pulls the locking block 115, which is turned to be fixed in position and locked after arriving an end point; the tensile spring provides a reverse pulling force to the hanging hook 116; the connection block 112 and the locking block 115 are slidable inside the position limiting guiding slot 150.

During use, the position limiting guiding slot 150 and the sliding slot 170 are positioned right above the fixed slot 130 under a retracted condition. Under an extended condition, the position limiting guiding slot 150 and the sliding slot 170 are positioned away from the fixed slot 130, and are locked in position at an end point; at this moment, frictional force between the cylinder 113 and the piston rod 114 is almost zero, thereby achieving silencing effect. The present invention eliminates noises conventionally produced when the basket is pulled out from the kitchen cupboard by using the hydraulic damper 110 which provides better users' experience. Besides, the hydraulic damper 110 eliminates noises when the basket is pulled out, thereby enhancing the comfort of living.

The above detailed and specific description only describes an embodiment of the present invention. It should not be understood as limiting the scope of the present invention. It should be noted that, a person skilled in this field of art may change and modify the present invention without deviating from the inventive concept of the present invention, and all these changes and modifications should also fall within the scope of protection of the present invention. The scope of protection of the present invention is defined by the appended claims.

What is claimed is:

1. A pull-out basket for kitchen cupboard, comprising a basket and two sliding rail structures; the basket is mounted above the two sliding rail structures; each of the sliding rail structures comprises a fixed slot; the fixed slot is embodied as a linear tube; one end of the fixed slot is removably provided with a fixed sleeve; a middle section of the fixed slot is mounted with a hydraulic damper; another end of the fixed slot is provided with a fixed seat and a second sliding gear rack; through holes are respectively provided on the fixed seat and the fixed sleeve; an outer side of the second sliding gear rack is provided with a position limiting guiding slot; the position limiting guiding slot is connected with a first sliding gear rack through a gear; the first sliding gear rack is mounted with a sliding slot; the hydraulic damper comprises a cylinder; an end of the cylinder is connected with a piston rod; a tensile resilient member is mounted below the cylinder; the piston rod and the tensile resilient member is connected with a connection block; the connection block is connected with a locking block; a hanging hook is connected onto the sliding slot; intermediate blocks are provided at a bottom side of the basket; each of the intermediate blocks is connected with the sliding slot via a bolt or a screw.

2. The pull-out basket for kitchen cupboard of claim 1, wherein the tensile resilient member is a tensile spring.

3. The pull-out basket for kitchen cupboard of claim 2, wherein the tensile spring provides a reverse pulling force to the hanging hook.

4. The pull-out basket for kitchen cupboard of claim 1, wherein the hydraulic damper achieves silencing and buffering effects when the sliding rail structures extend and retract.

5. The pull-out basket for kitchen cupboard of claim 1, wherein the hanging hook pulls the locking block, which is turned to be fixed in position and locked after arriving an end point.

6. The pull-out basket for kitchen cupboard of claim 1, wherein the connection block and the locking block are slidable inside the position limiting guiding slot.

7. The pull-out basket for kitchen cupboard of claim 1, wherein the fixed sleeve is made of plastics.

* * * * *